US009087466B1

(12) United States Patent
Evans

(10) Patent No.: US 9,087,466 B1
(45) Date of Patent: Jul. 21, 2015

(54) DISPLAY FOR MOUNTED TIRE

(71) Applicant: Robert D. Evans, Farmington, UT (US)

(72) Inventor: Robert D. Evans, Farmington, UT (US)

( * ) Notice: Subject to any disclaimer, the term of this patent is extended or adjusted under 35 U.S.C. 154(b) by 15 days.

(21) Appl. No.: 14/257,165

(22) Filed: Apr. 21, 2014

(51) Int. Cl.
*G09F 23/00* (2006.01)

(52) U.S. Cl.
CPC ..... *G09F 23/00* (2013.01)

(58) Field of Classification Search
CPC ..... G09F 21/045; B60B 7/20; B60B 7/0053; A47F 7/04
USPC ..... 40/587; 301/37.108, 37.22; D12/212, D12/208, 204
See application file for complete search history.

(56) References Cited

U.S. PATENT DOCUMENTS

| | | | | | |
|---|---|---|---|---|---|
| 2,036,757 | A | * | 4/1936 | Hume | 301/5.21 |
| 2,049,918 | A | * | 8/1936 | Marsh | 301/5.21 |
| 2,070,995 | A | * | 2/1937 | Mechling | 301/5.21 |
| 2,137,416 | A | * | 11/1938 | Rubsam | 301/5.21 |
| 2,529,099 | A | * | 11/1950 | Olbrys | 301/5.21 |
| 2,644,721 | A | | 7/1953 | Grimshaw | |
| 2,775,487 | A | * | 12/1956 | Hennecke | 301/5.21 |
| 2,847,250 | A | * | 8/1958 | Hennecke | 301/5.21 |
| 3,426,463 | A | | 2/1969 | Weisenbach | |
| 3,633,263 | A | * | 1/1972 | Hoeksema | 29/412 |
| 3,769,729 | A | | 11/1973 | Engler | |
| 4,068,898 | A | * | 1/1978 | Hanson | 301/5.21 |
| 4,194,810 | A | | 3/1980 | Eller | |
| 4,269,451 | A | * | 5/1981 | Narang | 301/5.21 |
| 5,228,754 | A | | 7/1993 | Rogers | |
| 6,641,225 | B1 | * | 11/2003 | Amodeo, Jr. | 301/37.103 |
| 6,871,987 | B1 | * | 3/2005 | Morton | 362/500 |
| 7,472,966 | B2 | | 1/2009 | Goodman et al. | |
| 7,566,101 | B2 | | 7/2009 | Jenkins et al. | |
| 2009/0127919 | A1 | * | 5/2009 | Burnett | 301/5.21 |
| 2011/0204704 | A1 | * | 8/2011 | Halle et al. | 301/5.21 |

* cited by examiner

*Primary Examiner* — Casandra Davis
(74) *Attorney, Agent, or Firm* — Brian C. Trask

(57) ABSTRACT

A display device to broadcast information from a tire mounted on a wheel. The display device includes a foot that is anchored in compression between part of the tire sidewall and the rim of the wheel. The compression between an inflated tire and rim of the wheel on which the tire is mounted is sufficient to hold preferred embodiments of the display device in an installed position during conventional use of the tire. Information can be broadcasted visually, or by way of radio waves, and the like.

17 Claims, 5 Drawing Sheets

DISPLAY FOR MOUNTED TIRE

BACKGROUND

1. Field of the Invention

This invention relates to informational devices, such as advertising or data collection devices. It is particularly directed to a display device, or broadcasting device, having a foot that is anchored between an inflated tire and the rim of a wheel on which the tire is mounted.

2. State of the Art

Various devices that can be associated with a mounted pneumatic tire and its wheel are known. One exemplary such device includes the ubiquitous wheel balancing weight conventionally used to balance an inflated tire mounted on the rim of an automotive wheel. Exemplary wheel weights are disclosed in U.S. Pat. Nos. 5,228,754, and 7,566,101. A wheel balancing weight typically includes a weight that is attached to a metal clip structured to be installed onto the rim of the wheel on which the inflated tire is mounted. The metal clip is typically installed by hammering the clip onto the rim. The installed clip is self-biased to hold onto the rim, and the installed weight is typically disposed in contact with the rim to additionally resist centrifugal force. Never-the-less, it is common for wheel weights to fall off, requiring tires to be re-balanced on a regular schedule.

Another device that can be anchored to a wheel rim is disclosed in U.S. Pat. No. 4,194,810. This device is a safety reflector, and provides feedback that indicates if a wheel is actually rotating. The anchor of the reflector is similar to a tire weight anchor, and includes a resilient clip that grips the wheel rim. A protruding bulge rests against the inside surface of the rim to resist centrifugal force when the wheel is rotating. The bulk of the reflector projects radially outward from the rim to overlap a portion of the tire.

An early development to dispose an ornament in association with a wheel is disclosed in U.S. Pat. No. 2,644,721. This device includes a spring element installed to grip a rim. An anchoring portion is shaped in harmony with a wheel to cause a biased interference and grip onto the rim. After installation, a spring portion can then hold a cover, or trim ring, in biased engagement with the rim. Other devices known for holding display devices in association with a wheel are disclosed in U.S. Pat. Nos. 7,472,966; 3,769,729; and 3,426,463.

BRIEF SUMMARY OF THE INVENTION

This invention provides a display device for an automotive tire that is mounted on a wheel. Exemplary embodiments include a foot and a display device affixed to the foot. The foot is structured for installation to cause captured engagement of a portion of the foot in compression between an inflated tire and the rim of a wheel on which that tire is mounted. Sometimes, a foot may encompass a plurality of sub-foot elements that cooperate to serve as an anchor. A workable foot is structured to facilitate installation to dispose a terminal portion of the foot over about 50% or less of the local radial seal surface length of the tire-to-rim. Desirably, the captured engagement is sufficient, on its own, to maintain the foot (and display device), in an installed position during conventional use of the tire. However, certain embodiments may additionally include structure arranged to contact the rim to further resist centrifugal force during tire rotation.

Sometimes, a foot carries friction-enhancing structure configured to enhance friction between the foot and tire. One operable friction-enhancing structure includes one or more rib. An alternative friction-enhancing structure includes a plurality of fingers. It is within contemplation that a foot may also, or alternatively, carry friction-enhancing structure configured to enhance friction between the foot and rim. In the latter case, a friction-enhancing structure can include a high-tack element, such as soft rubber, glue, double-sided tape, or other sticky element.

Sometimes, a display device is structured such that, subsequent to installation onto a mounted tire, the display device extends radially inward from attachment to the foot. In other cases, a display device may be structured such that, subsequent to installation onto a mounted tire, the display device extends radially outward from attachment to the foot. Certain embodiments may extend in both radial directions.

A currently preferred display device carries a visible advertisement. One such embodiment encompasses a substantially flat area about two inches in length and about one-half inch in width onto which the visible advertisement may be affixed. Preferably, a display area is bounded by a protruding rim to resist peeling of an affixed advertisement, or other element. A display device may carry a computer-readable code, such as a bar code, or QR code. In certain cases, a display device forms a container in which an object, such as an RFID broadcasting device, may be stored to associate that object with the tire and wheel.

Certain embodiments include a hinge disposed between the display device and a terminal portion of its associated foot. A hinge can accommodate mounting a single embodiment of a display device onto a variety of different tires having a plurality of side-wall shapes. Preferably, the hinge is self-biased to urge a portion of the display device into engagement with the sidewall of an inflated tire.

The invention may be embodied in a method to associate a display device with a mounted tire. One such method includes providing a display device attached to a foot; disposing the foot between a tire and a rim portion of a wheel on which the tire is mounted; and pressurizing the tire to trap the foot in compression between the tire and the wheel. Desirably, the compression, by itself, causes a retaining force sufficient to maintain the display device in an installed position during subsequent conventional use of the mounted tire. Sometimes, pressure in the tire is reduced prior to disposing the foot between the tire and rim portion. The device may be installed prior to first inflating the tire. A workable method may include using a lever to pry the tire away from a local rim portion prior to disposing the foot between the tire and that rim portion. The method may further include balancing the wheel and inflated tire after installing the display device.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of certain principles of the present invention, and should not be viewed as narrowing the claims which follow.

Figure 1:
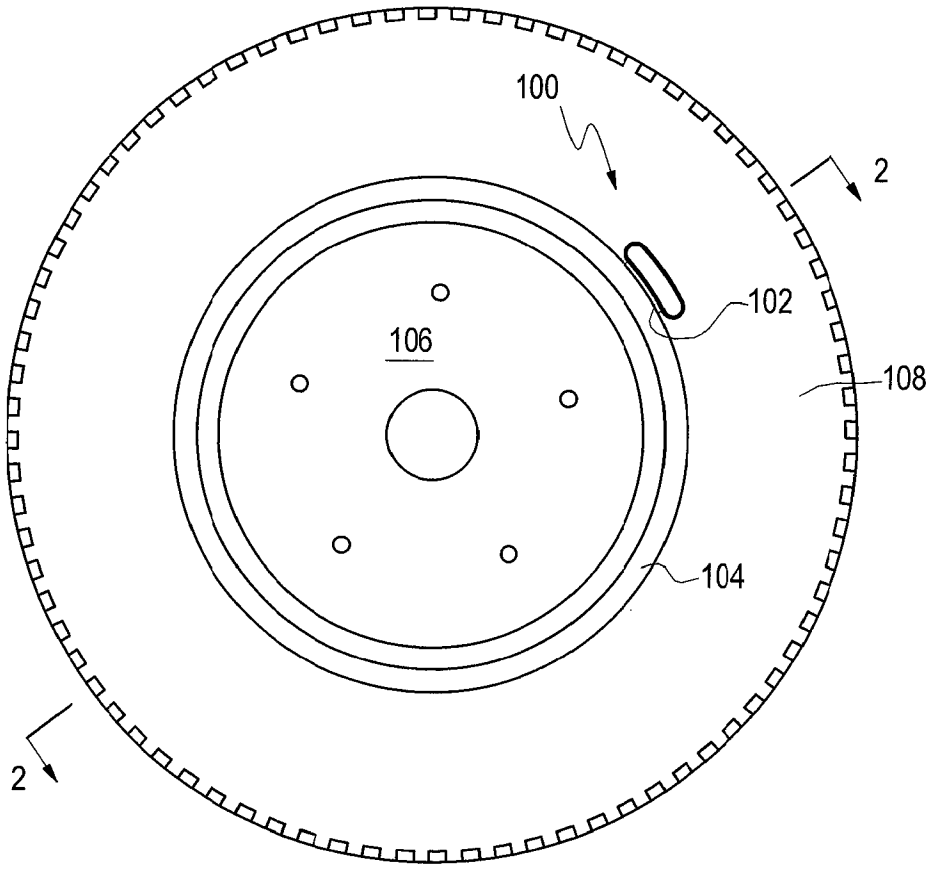
FIG. 1 is a side view of an embodiment of the invention installed on a mounted tire.

An embodiment of a display device according to certain aspects of the invention is indicated generally at 100 in FIG. 1. Display device 100 includes a carrier, generally 101, that is attached to an anchoring foot 102. Illustrated foot 102 tapers toward distal edge 103. A carrier 101 may be embodied in many different configurations, certain of which are discussed in detail below. A carrier 101 is structured to broadcast information, which may be transmitted visually, or by radio waves, and the like. A portion of foot 102 is installed in compression between the rim 104 of wheel 106 and an inflated tire 108. Desirably, the interaction between the entrapped portion of foot 102 with tire 108 and rim 104, alone, is sufficient to maintain a display device 100 in association with the mounted tire 108 during conventional use of the tire 108.

Figure 2:
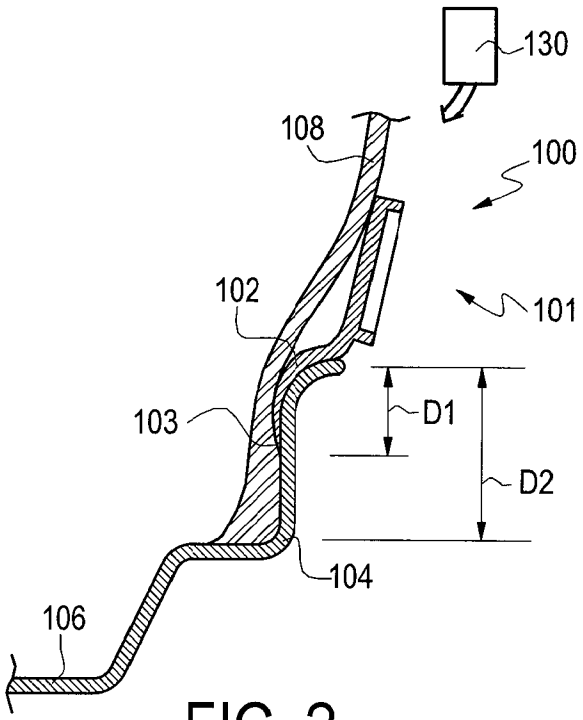
FIG. 2 is a close-up fragmentary cross-section view taken through section 2-2 indicated in FIG. 1.

Details of one preferred anchoring arrangement are illustrated in FIG. 2. As illustrated, a portion of foot 102 is installed to dispose a terminal portion of the foot 102 to extend by a distance D1 over the local radial seal surface length D2 of tire 108 and rim 104. Preferably, distance D1 is about 50% or less of the local radial seal surface length D2.

With reference to FIGS. 3-6, embodiments of a workable display device 100 may take on a variety of different aspects and/or configurations. For example, in FIG. 3, it is desirable for a display device 100 to be installation inside the plane 110 containing transverse edge 112 of rim 104. In that case, the wheel 106 and tire 108 can cooperate as a shield to resist scrubbing the device 100 from an installed position, e.g. by driving too close to a curb, or vertical post.

Figure 3:
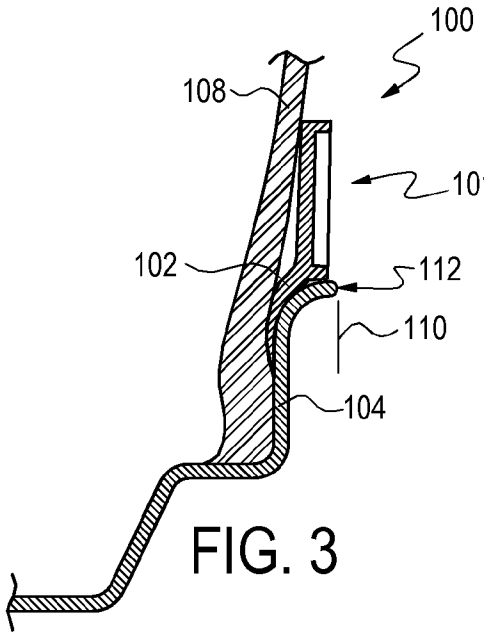
FIGS. 3-6 are side views, similar to that in FIG. 2, of alternative embodiments.
Figure 4:
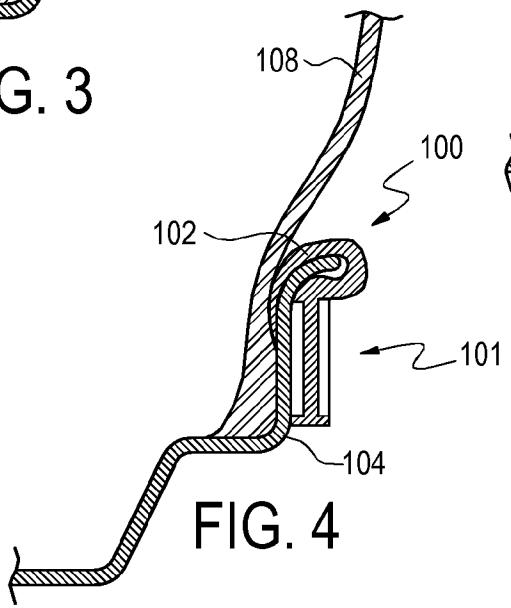

A comparison of FIGS. 3 and 4 reveals that a display device 100 may, subsequent to installation onto a mounted tire, extend either radially inward (e.g. FIG. 4) from attachment of a carrier device 101 to a foot 102, or radially outward (e.g. FIG. 3) from that attachment location. It is further contemplated that a display device 100 may extend radially in both directions from the site of attachment of a carrier device 101 to a foot 102.

Figure 5:
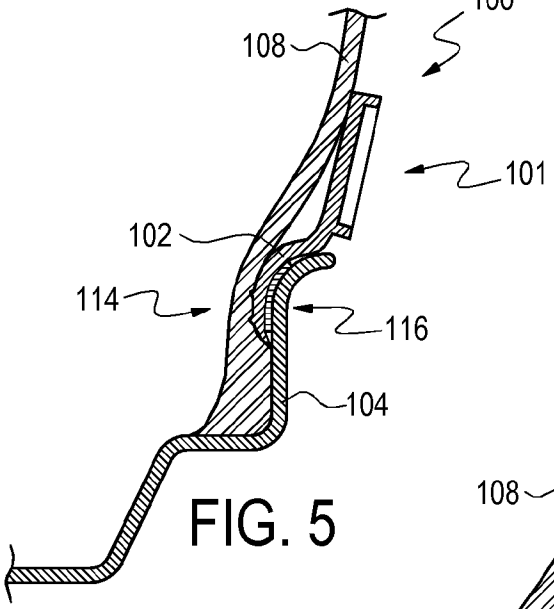

With reference to FIG. 5, certain embodiments of a foot 102 may carry one or more friction-enhancing element. At the tire/foot interface generally indicated at 114, a foot 102 may carry one or more protrusion adapted to interfere with the adjacent contacted surface of a tire 108 effective to increase retention force that is generated under compression between the elements. A workable protrusion may non-exclusively encompass a rib, dimple, or finger. A workable friction-enhancing surface of a foot 102 may simply be "rough".

As further illustrated at the foot/rim interface indicated generally at 116 in FIG. 5, a high-tack element may be disposed between a surface of a foot 102 and a rim 104. A workable high-tack element may include an element such as a thin sheet of rubber, double-sided tape, adhesive, glue, contact cement, or other "sticky" substance. In an alternative embodiment, a high-tack element may similarly be disposed at interface 114 between a tire 108 and the cooperating adjacent surface of a foot 102.

Figure 6:
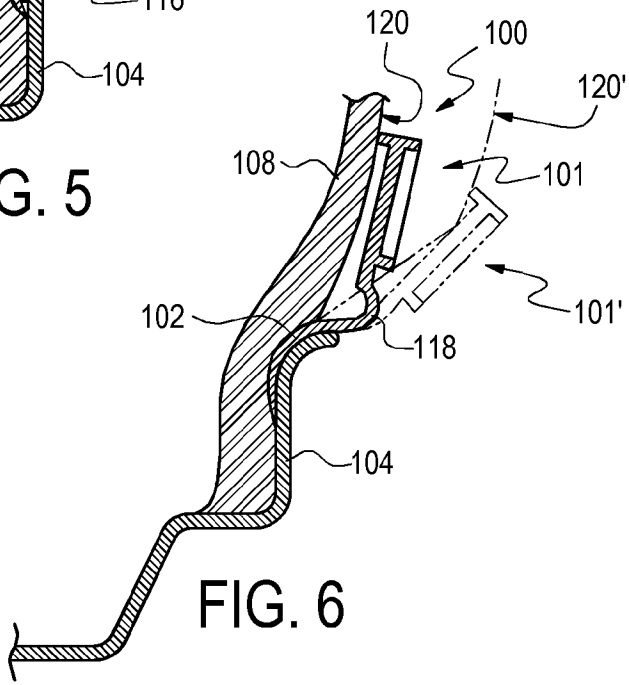

With particular reference to FIG. 6, it is typically desirable to include a biasable hinge element 118 between a foot 102 and carrier element 101. When display device 100 in FIG. 6 is installed onto a first tire, carrier 101 is biased into contact with tire surface 120 by hinge 118. When display device 100 in FIG. 6 is installed onto a second tire (having a different cross-section shape and indicated in phantom line), a hinge 118 may deflect to accommodate the different shape, and place carrier 101' into biased contact with surface 120'.

In general, it is preferred that an installed display device 100 is structured to bias a distal part of carrier 101 into contact with a surface, to avoid vibration, noise, and fatigue failure causing separation of carrier device 101 from the anchoring foot 102. As illustrated in FIGS. 3, 5, and 6, a distal part of carrier 101 is biased into engagement with a sidewall surface of the tire 108 at a larger radius compared to the site of attachment to foot 102. In FIG. 4, a distal part of carrier 101 is biased into engagement with a surface of rim 104 at a smaller-radius, compared to the attachment site to foot 102.

Figure 9:
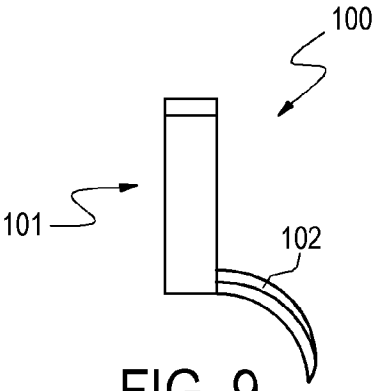
FIG. 9 is a side view of the embodiment in FIG. 7.
Figure 8:
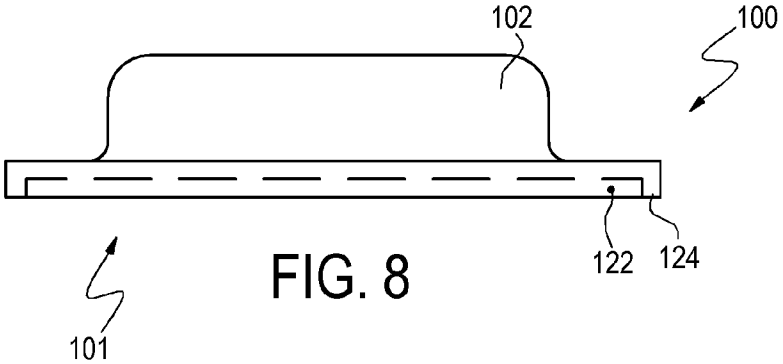
FIG. 8 is a top view of the embodiment in FIG. 7.
Figure 7:
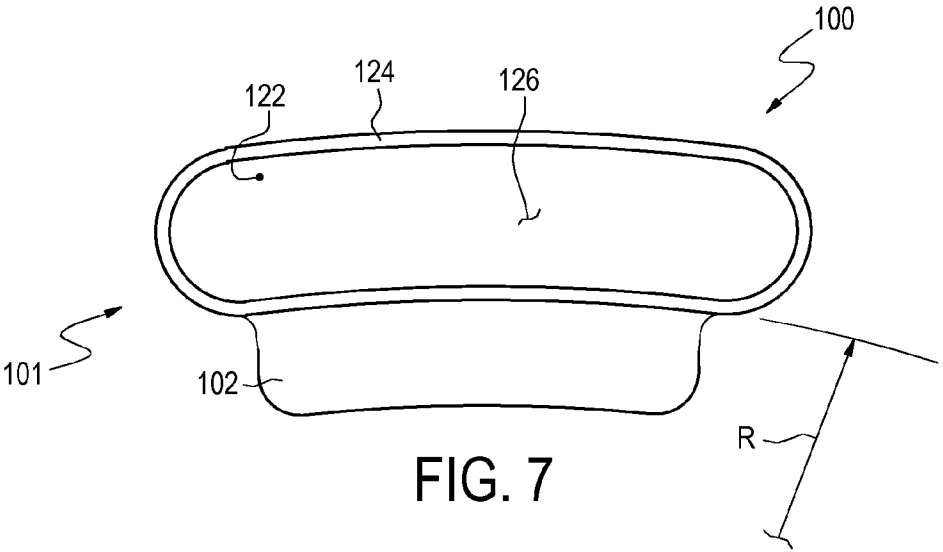
FIG. 7 is a front view of a currently preferred embodiment.

One currently preferred embodiment of a display device 100 is illustrated in FIGS. 7-9. The carrier device 101 is attached to a curved foot 102. Foot 102 may be characterized as a relatively thin membrane. A thickness of foot 102 disposed between the tire 108 and rim 104 is typically less than about 0.050 inches. However, any thickness and length of the installed portion that does not interfere with forming an effective tire-to-rim air seal is workable. Of course, in tube-type tires, the foot size and shape is less important.

Desirably, foot 102 is shaped in general agreement with a cooperating profile shape of a wheel rim 104. However, it is within contemplation that a foot 102 may be sufficiently transversely compliant as to accommodate to the profile of a rim 104 under influence of an installed tire 108. That is, a sufficiently compliant foot 102 may even be manufactured in a substantially straight, or planar, configuration. Such a planar foot 102 can then transversely deflect during installation, and under influence of a tire, to conform to the shape of a rim.

It is currently preferred for a carrier device 101 to include a socket 122 bounded by a protruding rim 124. Desirably, socket 122 provides a surface 126 onto which a visible element (not illustrated) may be affixed, or otherwise displayed. The protruding rim 124 can help to resist undesired peeling of an adhered label from surface 126. Visible elements may non-exclusively include Company Logos, advertisements, and computer-readable elements, such as bar codes and QR codes, and the like. Visible elements may be painted-on, included as a substrate in a casting or molding, or preferably, carried on an affixed label.

The currently preferred embodiment of a display device 100, such as illustrated in FIGS. 7-9, includes a surface 126 extending in a circumferential direction by about 2 inches, and a radial direction by about ½ inches. Other sizes and shapes are workable. For example, when the embodiment 100 is structured for installation on a wheel 106 having a smaller radius (e.g. radius R is perhaps 14 inches or less), it may be desirable to shape the carrier 101 in harmony with that radius R. Other times, it may be sufficient for the display surface 126 to include radially spaced-apart edges that are substantially straight.

Figure 12:
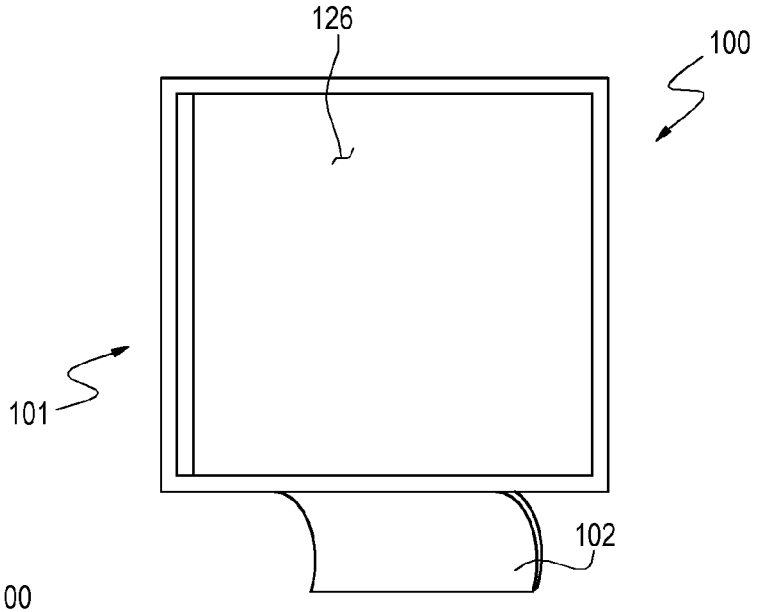
FIG. 12 is a perspective view of an alternative embodiment.
Figure 10:
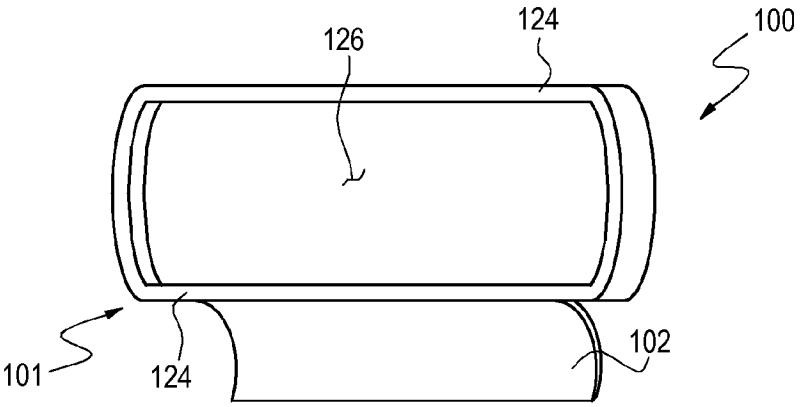
FIG. 10 is a perspective view of an alternative embodiment.
Figure 11:
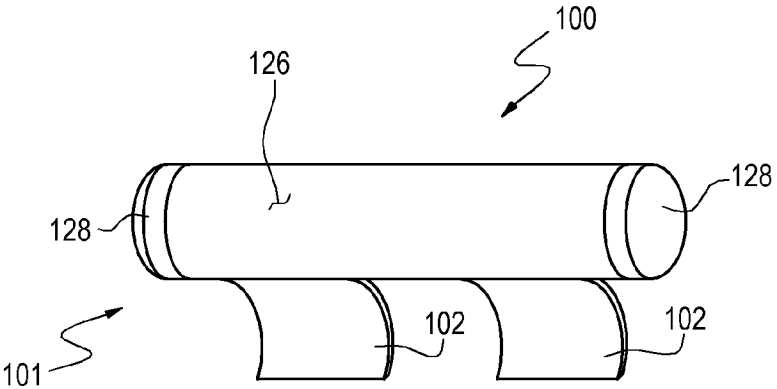
FIG. 11 is a perspective view of an alternative embodiment.

FIGS. 10-12 illustrate a plurality of embodiments of display devices 100 within the ambit of the invention. FIG. 10 illustrates an embodiment 100 having radially spaced-apart rims 126 that are substantially straight. Its display surface 126 is generally rectangular, and is bounded by protruding rim 124. Embodiment 100 in FIG. 11 includes a display surface 126 that is arcuate, and lacking in any protruding rim. Display surface 126 in FIG. 11 is configured to define an interior space, sealed on its ends by oppositely-disposed caps 128. One or more cap 128 desirably is removable, to permit placing an item into confined reception inside the device 100. Items within contemplation for storage inside the container formed by surface 126 in FIG. 11 nonexclusively include an RFID transmitter. Of note in FIG. 11 is that a display device 100 may include more than one foot 102.

The configuration of surface 126 of the display device 100 illustrated in FIG. 12 is adapted to display a bar code, particularly a QR code. A representative surface 126 in embodiment 100 of FIG. 12 is sized about 1 inch in a circumferential direction, and about 1 inch in a radial direction.

Figure 15:
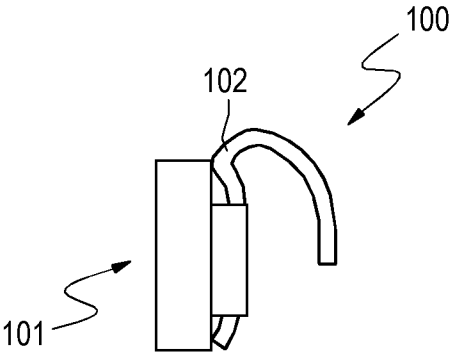
FIG. 15 is a side view of the embodiment in FIG. 13.
Figure 14:
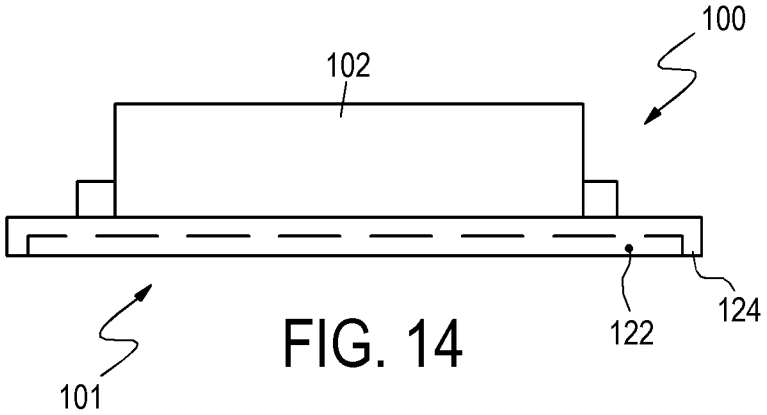
FIG. 14 is a top view of the embodiment in FIG. 13.
Figure 13:
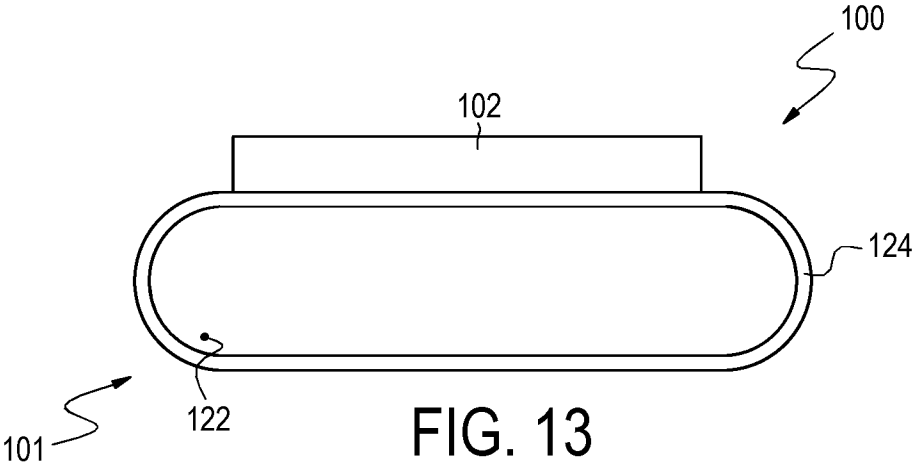
FIG. 13 is a front view of an alternative embodiment.

A less-preferred embodiment 100 is illustrated in FIGS. 13-15. That display device 100 includes a foot 102 made from a commercially available metal clip that is conventionally used as a constituent element to form a tire weight. The metal clip-foot 102 may be affixed to a plastic carrier device 101 by plastic injection molding. Injected plastic can flow through one or more aperture in the clip-foot, and cause an interference. Carrier device 101 includes a socket 122 essentially surrounded by a protruding rim 124. A socket 122 may be any size and shape desired. This embodiment 100 is currently considered as less-desirable, because it is susceptible to separation from a mounted tire-and-wheel to somewhat the same extent as a conventional wheel weight.

Although other materials and manufacturing methods are workable, it is currently preferred to make devices 100 by plastic injection molding. Plastic, or plastic-like materials possess sufficient tensile and bending strength, and are durable for long life in an outdoor environment. It is within contemplation also to combine a plurality of materials, e.g. to add a metal clip to a plastic carrier.

A device 100 may be installed onto a tire and wheel by first installing the tire onto the wheel, and pressurizing the tire to seat the sealing bead against the rim. Then, pressure is released from the tire, and a local portion of tire is deflected away from the rim sufficient distance to insert a foot 102 between the tire and rim. Then, the tire can be inflated to its operating pressure, and trap the foot 102 between the tire and rim. The operating tire pressure typically generates a retaining compression force sufficient to maintain the device 100 in an installed position. Sometimes, a prying tool 130 (see FIG. 2), such as a screwdriver or tire iron, may be used to assist in deflecting the tire sidewall from the rim at an installation site. Sometimes, a sticky element, such as double-sided tape, may be added to a foot 102 to assist in holding the foot at a desired position during inflation of the tire.

While the invention has been described in particular with reference to certain illustrated embodiments, such is not intended to limit the scope of the invention. The present invention may be embodied in other specific forms without departing from its spirit or essential characteristics. For example, elements illustrated or described with reference to certain illustrated embodiments may be combined with elements illustrated or described with reference to other embodiments. Modifications to illustrated structure effective to accommodate any particular embodiment to a particular wheel will be apparent to one of ordinary skill-in-the-art. The described embodiments are to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a foot structured for installation to cause captured engagement of a portion of said foot in compression between an inflated tire and the rim of a wheel on which said tire is mounted, said captured engagement extending around less than one-half the circumference of said wheel and being sufficient to maintain said foot in an installed position during conventional use of said tire; and a display device attached by way of a hinge to said foot; wherein:

said apparatus is structured such that, subsequent to installation of said apparatus onto a mounted and inflated tire, said display device extends radially outward from attachment to said foot and said hinge is biased to urge a portion of said display device into engagement with the sidewall of said inflated tire at a location spaced apart from said foot.

2. The apparatus according to claim 1, wherein:

said display device carries a visible advertisement.

3. The apparatus according to claim 1, wherein:

said display device carries a computer-readable code.

4. The apparatus according to claim 3, wherein:

said display device carries a bar code.

5. The apparatus according to claim 1, wherein:

said display device forms a container in which an object may be stored to associate that object with said tire and wheel.

6. The apparatus according to claim 1, wherein:

said display device encompasses a substantially flat area about two inches in length and about one-half inch in width.

7. The apparatus according to claim 1, wherein:

a display area of said apparatus is bounded by a protruding rim.

8. The apparatus according to claim 1, wherein:

said foot is structured to facilitate installation of said apparatus to dispose a terminal portion of said foot over about 50% or less of the local radial seal surface length of said tire to said rim.

9. The apparatus according to claim 1, wherein:

said foot carries friction-enhancing structure configured to enhance friction between said foot and said tire.

10. The apparatus according to claim 9, wherein:

said friction-enhancing structure comprises a rib.

11. The apparatus according to claim 9, wherein:

said friction-enhancing structure comprises a plurality of fingers.

12. The apparatus according to claim 1, wherein:

said foot carries friction-enhancing structure configured to enhance friction between said foot and said rim.

13. The apparatus according to claim 12, wherein:

said friction-enhancing structure comprises a high-tack element.

14. An apparatus, comprising:

a foot structured for installation to cause captured engagement of a portion of said foot in compression between an inflated tire and the rim of a wheel on which said tire is mounted, said captured engagement extending around less than one-half the circumference of said wheel and less than about 50% of the radial seal length between said tire and said rim, the portion of said foot disposed in said captured engagement in compression between an inflated tire and rim providing the principal anchor to maintain said foot in an installed position during conventional use of said tire; and a display device attached to said foot by way of a hinge; wherein said foot and said hinge consist of plastic, or plastic-like, material; and said apparatus is structured such that said installation is effective to place said hinge into a biased condition effective to urge a portion of said display device into contact with a surface at a location spaced apart from said foot.

15. The apparatus according to claim 14, wherein:

at an installed position on a rim, said display device extends radially inward from said foot.

16. The apparatus according to claim 14, wherein:

said foot has a maximum thickness of less than about 0.050 inches and is transversely compliant to accommodate to the surface of a rim under influence of an inflated tire.

17. The apparatus according to claim 16, wherein:

said foot is tapered toward a distal edge, and said foot carries a plurality of fingers structured to enhance friction at the interface with said tire; and said apparatus is structured such that, upon installation, a portion of said display extends radially outward to contact a sidewall of said tire.

* * * * *